US010544573B2

(12) United States Patent
Yang et al.

(10) Patent No.: US 10,544,573 B2
(45) Date of Patent: Jan. 28, 2020

(54) WASHSTAND CABINET

(71) Applicant: LG ELECTRONICS INC., Seoul (KR)

(72) Inventors: Inhyung Yang, Seoul (KR); Seongho Kim, Seoul (KR); Jinhyeon Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/783,480

(22) Filed: Oct. 13, 2017

(65) Prior Publication Data

US 2018/0106027 A1 Apr. 19, 2018

(30) Foreign Application Priority Data

Oct. 14, 2016 (KR) ..... 10-2016-0133443

(51) Int. Cl.
*E03C 1/326* (2006.01)
*E03C 1/182* (2006.01)
*A47K 10/48* (2006.01)

(52) U.S. Cl.
CPC ..... *E03C 1/326* (2013.01); *A47K 10/48* (2013.01); *E03C 1/182* (2013.01)

(58) Field of Classification Search
CPC .... A45D 19/04; A45D 19/08; A47B 47/0091; A47B 77/06; A47K 1/02; A47K 10/06; A47K 10/48; A47K 2210/00; A61G 12/008; E03C 1/18; E03C 1/186; E03C 1/326
USPC ..... 312/228, 237; 361/731; 4/451, 480, 514, 4/516–518, 619, 625, 630, 638, 670
See application file for complete search history.

(56) References Cited

U.S. PATENT DOCUMENTS 4,742,429 A * 5/1988 Arrendiell ..... A47K 17/00 200/61.62
5,702,115 A * 12/1997 Pool ..... A61G 12/001 280/47.35
5,915,851 A * 6/1999 Wattrick ..... A47B 77/022 4/619
6,525,298 B1 * 2/2003 Hunts ..... A47K 10/06 219/385
7,743,439 B2 * 6/2010 Switzer ..... A47K 1/02 4/625
8,322,169 B2 * 12/2012 Kendall ..... D06F 29/00 68/13 R
8,652,413 B2 * 2/2014 Vitali ..... A61G 7/0005 4/625
2009/0302724 A1 * 12/2009 Allard ..... F25D 17/042 312/237

(Continued)

FOREIGN PATENT DOCUMENTS

DE 10305311 * 8/2004 ..... A47B 77/06
KR 20-2013-0003854 6/2013

*Primary Examiner* — Erin Deery
*Assistant Examiner* — Nicholas A Ros
(74) *Attorney, Agent, or Firm* — Ked & Associates, LLP

(57) ABSTRACT

Disclosed is a washstand cabinet. The washstand cabinet includes a washstand having a water supply valve and a washing bowl in which water is accommodated, a housing provided under the washstand and defining a storage space therein, at least one module accommodated inside the housing, the module being electrically operated, and a controller configured to recognize the module and control the recognized module.

13 Claims, 8 Drawing Sheets

(56) References Cited

U.S. PATENT DOCUMENTS

2014/0259382 A1* 9/2014 Dobizl ..... E03C 1/046
4/677

* cited by examiner (a)

(b)

(a)

(b)

(c)

WASHSTAND CABINET

CROSS-REFERENCE TO RELATED APPLICATION

This application claims priority under 35 U.S.C. § 119 to Korean Application No. 10-2016-0133443, filed on Oct. 14, 2016, whose entire disclosure is hereby incorporated by reference.

BACKGROUND

1. Field

The present disclosure relates to a washstand cabinet provided under a washstand, and more particularly, to a washstand cabinet in which an electrically-operated module is accommodated.

2. Background

A bathroom may have a relatively limited storage space for organizing bathroom articles, and an upper cabinet (also commonly referred to as a medicine cabinet) may be installed on a bathroom wall to provide additional space for organizing bathroom articles. The upper cabinet may be configured such that an accommodating space is formed within a main body, and a door having a mirror may be installed on the main body to enable the storage of bathroom articles in the accommodating space through the opened door.

In order to promote the utilization of a lower space in a bathroom under the upper cabinet, Korean Patent Application No. 20-2011-0011271 (published as KR 20-2013-0003854 on Jun. 28, 2013) teaches a lower cabinet that includes a modular storage space defined under a washstand. For example, a laundry basket may be accommodated in the storage space. However, this and other conventional bathroom cabinets do not include a separate device for providing a flow of air that may be used, for example, to remove water from a damp bathroom surface or a user or is circulated inside a washstand cabinet. The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Figure 1:
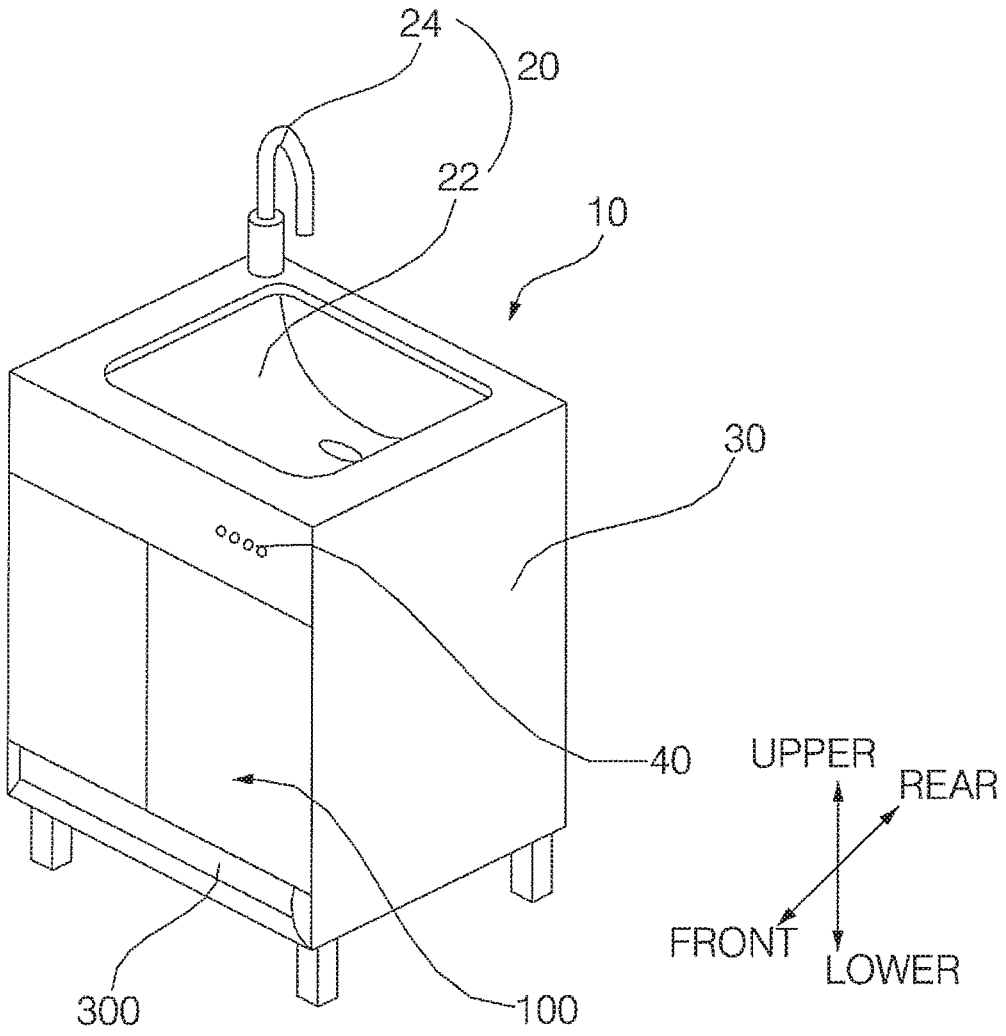
FIG. 1 is a perspective view illustrating a washstand cabinet according to an embodiment of the present disclosure.
Figure 2:
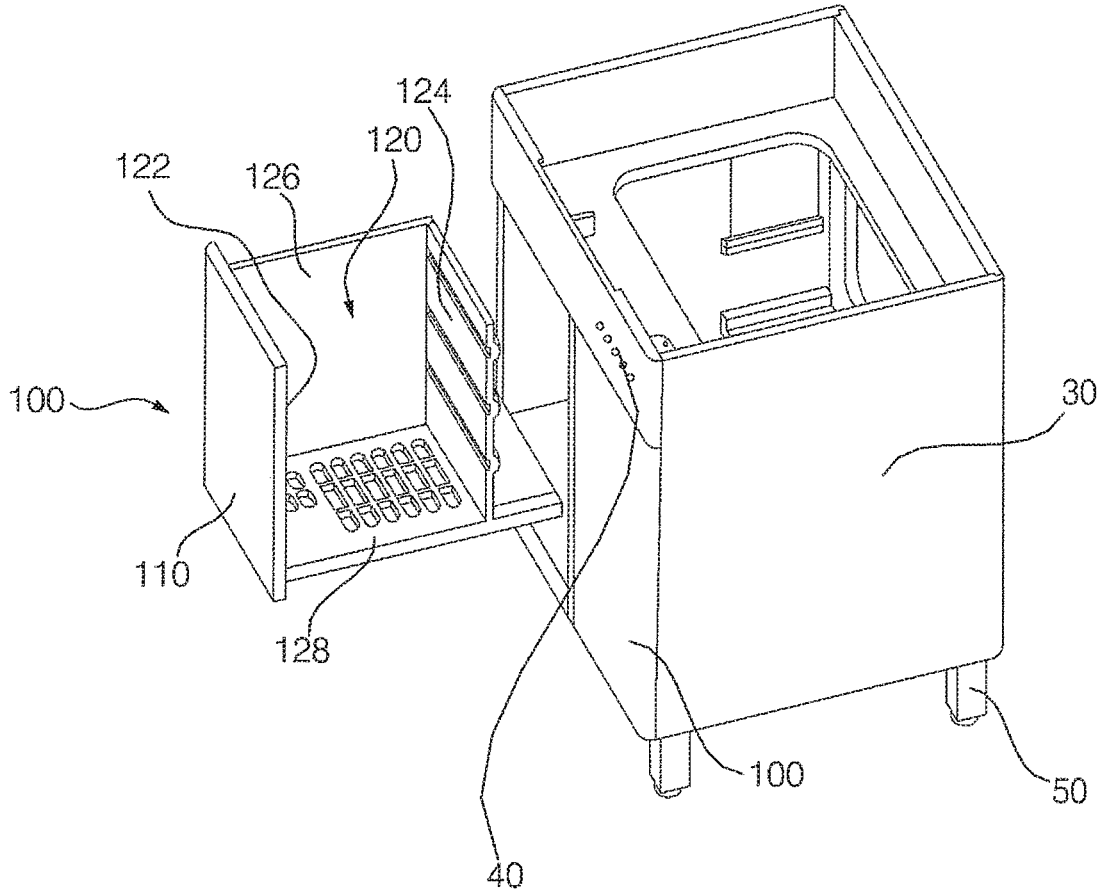
FIG. 2 is a perspective view of a housing in the state in which one module case is pulled outward according to the embodiment of the present disclosure.

Hereinafter, the present disclosure will be described with reference to the accompanying drawings to explain a washstand cabinet according to embodiments of the present disclosure.

The washstand cabinet 10 according to on embodiment may include a washstand 20, a housing 30 provided under the washstand 20 to define a storage space therein, at least one module (or electronic device) 200 accommodated inside the housing 30, and a controller 400. The module 200 may be electrically operated, and the controller 400 may be configured to recognize a type of the module 200 and to control the recognized module 200. The washstand cabinet 10 according to one embodiment may further include a module case (or case) 100, which divides the space inside the housing 30 into two or more spaces and accommodate the module 200 therein. The configuration of the washstand cabinet 10 according to the present embodiment will be described below with reference to FIGS. 1 to 7.

The washstand 20 may be a fixture that is provided at a wall or other region of a bathroom and is configured to enable a user to wash his/her hands or face. The water supply valve 24 may be provided on the upper end of the washstand 20. The washing bowl 22 may be concavely formed in a central portion of the washstand 20 to accommodate water therein. In addition, the washstand 20 may be is connected to a drain pipe (not illustrated) that drains the water accommodated in the washing bowl 22.

The washing bowl 22 may be formed, for example, as an enameled basin or an earthenware basin. In other examples, the washing bowl 22 may be provided in various different forms and materials. The washing bowl 22 may be the enameled basin, for example, so that the housing 30 may be easily coupled to the bottom of the washing bowl 22.

The housing 30 may be located under the washstand 20. The housing 30 may define an external shape at a periphery and bottom of the washstand cabinet 10. The top of the housing 30 may be connected to the washing bowl 22. In one example, the housing 30 may have an open top to receive the washing bowel 22. In order to prevent water used in a bathroom from entering the interior of the housing 30, a seal may be provided at a portion of the washing bowl 22 connected to or contacting the housing 30.

The housing 30 may be located under the washstand 20. The housing 30 may define an external shape at a periphery and bottom of the washstand cabinet 10. The top of the housing 30 may be connected to the washing bowl 22. In one example, the housing 30 may have an open top to receive the washing bowel 22. In order to prevent water used in a bathroom from entering the interior of the housing 30, a seal may be provided at a portion of the washing bowl 22 connected to or contacting the housing 30.

Cabinet legs 50 may be provided at a bottom of the housing 30 for spacing the washstand cabinet 10 apart from the floor of the bathroom by a given distance. However, the cabinet legs 50 may be omitted according to, for example, a use purpose of the washstand cabinet 10 and/or the desired space inside the washstand cabinet 10. When the cabinet legs are omitted, the bottom of the housing 30 may be positioned to directly contact the floor of the bathroom. In this configuration, the bottom of the housing 30 may be sealed along the floor of the bathroom in order to prevent water in the bathroom from entering the interior of the housing 30.

Figure 4:
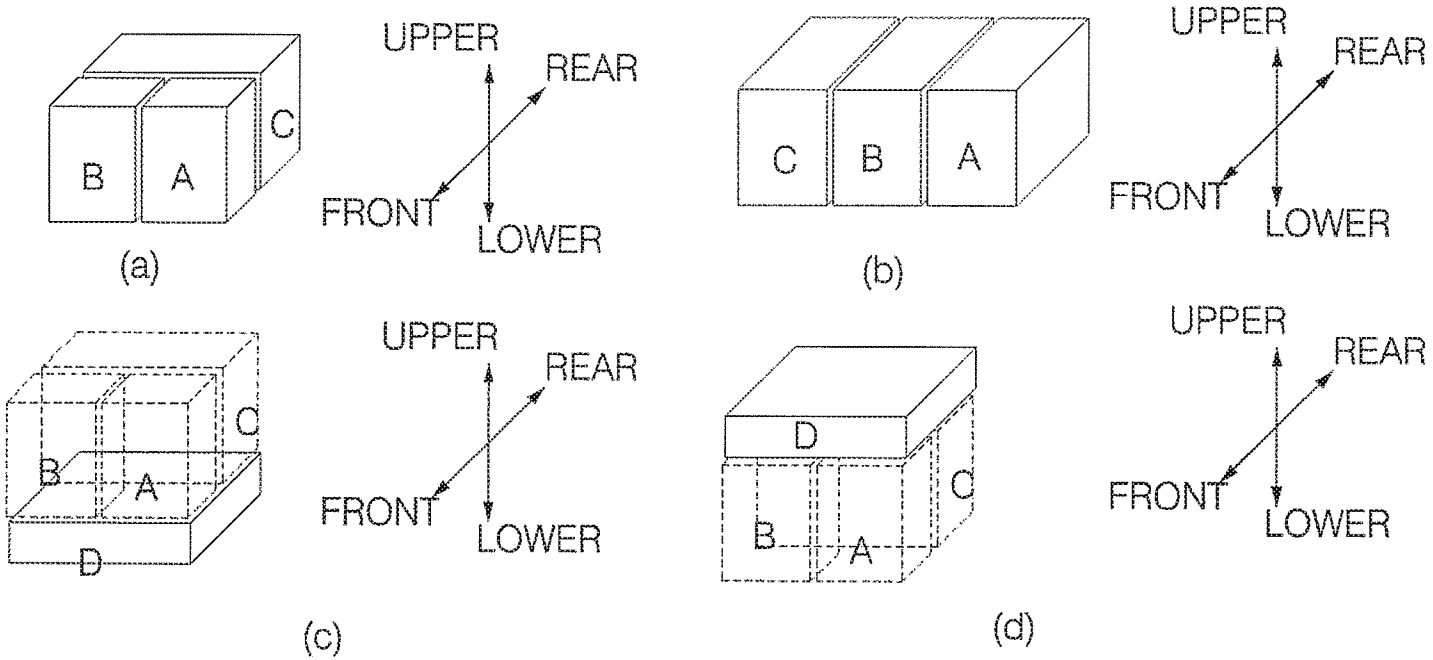
FIG. 4 shows views illustrating the arrangement relationship of modules according to embodiments of the present disclosure.

One or more modules 200 may be provided inside the housing 30 (see FIG. 4). The module 200 provided inside the housing 30 may include an electronic device that is used in the bathroom. The module 200 may have a standardized exterior shape. As described below, various different types of the module 200 may be included in the housing 30 to perform various functions or to provide different storage capabilities.

Referring to FIG. 4, modules inside the washstand cabinet 10 according to one embodiment may be provided in various forms within the housing 30. As illustrated in portion a of FIG. 4, two modules A and B may be provided in the front region of the housing 30 and one module C may be provided in the rear region of the housing 30. In this example, the drain facility (or drain pipe) that drains the water from the washstand 20 may be provided in the space of the module C at the rear region in housing 30. In another example illustrated in portion (b) of FIG. 4, three modules A, B and C may be arranged side by side.

As illustrated in portions (c) and (d) of FIG. 4, a flat, plate-like module D may also be provided. For example, module D may be provided in addition to modules A, B, and C depicted in portion (a) of FIG. 4. The module D shape may correspond to an air-conditioning module (or dryer) 300 that discharges air outward so as to dry the bathroom or a user. As shown in portion (c) of FIG. 4, the module D, corresponding the air-conditioning module 300, may be provided under the other modules A, B and C to dry a lower portion of the user (e.g., the user's legs) or a floor of the bathroom. In another example shown in portion (d) of FIG. 4, the module D, corresponding the air-conditioning module 300, may be provided over the other modules A, B and C to dry a higher portion of the user (e.g., the user's torso or legs) or a wall of the bathroom.

It should be appreciated that the specific arrangements of modules illustrated in FIG. 4 are given as examples, and the modules may be arranged in various ways in consideration of, for example, the number, position, and size of modules, and the size and use purpose of the housing. As described below, the module case 100 may receive and accommodate the module 200 may be provided inside the washstand cabinet 10 (see FIG. 2). The module case 100 may divide the inside of the housing 30 and may accommodate the module 200 therein, as represented in the different portions of FIG. 4.

An input unit (or user interface) 40 may be provided on the upper portion of the housing 30 and may be used to input a command to a controller 400 (see FIG. 3), which is provided inside the washstand cabinet 10 to control the module 200. In an example, shown in FIGS. 1 and 2, the input unit 40 may be formed on the upper portion of the housing 30 and immediately below the washstand 20 to be at a position at which the user may conveniently operate the input unit 40 in a standing posture.

The input unit 40 may include a button for receiving a control command related to an operation of the module 200 or the air-conditioning module 300 of the washstand cabinet 10 from the user (e.g., by a user contact of the button). In addition, the input unit 40 may include or be associated with a display (not illustrated), such as an liquid crystal display (LCD) or a display with light emitting diodes (LEDs) may be provided to visually display information related to the operating state. For example, the input unit 40 may be formed as a touch panel to simultaneously receive a user input and to display information to the user.

Figure 3:
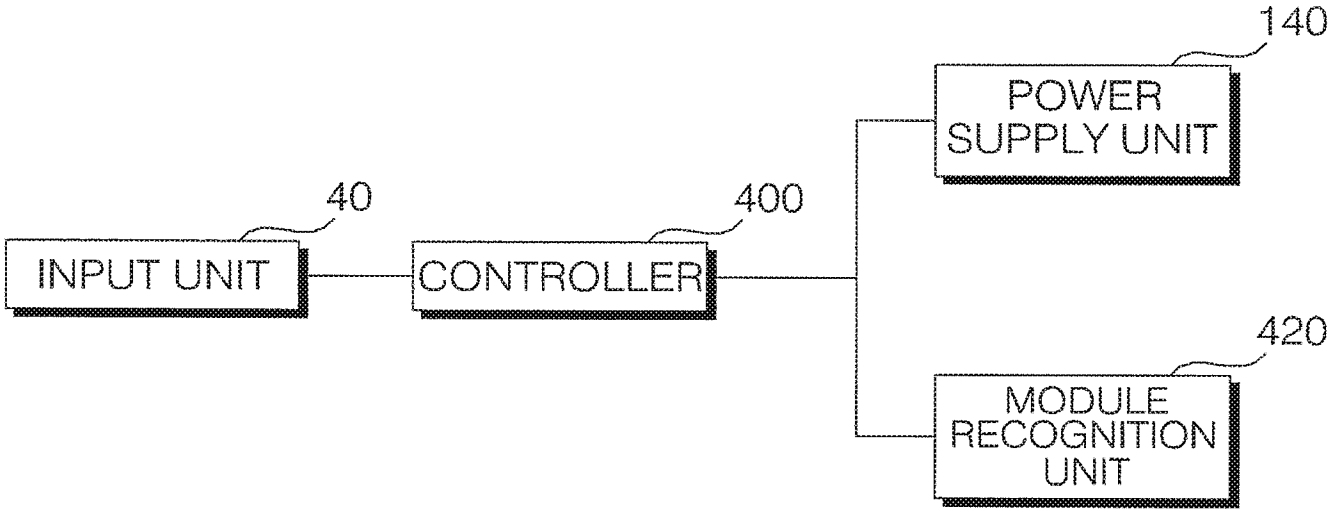
FIG. 3 is a block diagram illustrating a controller that controls a module and elements associated with the controller according to the embodiment of the present disclosure.

The controller 400 may be provided on the rear surface of the input unit 40 inside the housing 30 to recognize and control each module 200. Referring to FIG. 3, the controller 400 may be connected to a module recognition unit (or module recognition processor) 420. The controller 400 may determine the type of module 200 based on a signal transmitted from the module recognition unit 420 and may perform control depending on the type of module 200. For example, the controller 400 may be connected to a power supply unit 140 to selectively supply power to each module 200. The controller 400 may be connected to the input unit 40 to control each module 200 in response to a user input command related to the operation of the module 200. For example, the controller 400 may determine a type of the module 200 via the module recognition unit 420 and may perform control required for the functioning of the recognized module 200. In one example, the controller 400 and the module recognition unit 420 may be a single processor or may be a group or array of processors (e.g., a field-programmable gate array (FPGA) or other integrated circuit).

As previously described, the washstand cabinet 10 according to one embodiment may further include one or more module case 100 that divide the space inside the housing 30 into two or more spaces and accommodate the module(s) 200 therein. Hereinafter, the module case 100 will be described with reference to FIGS. 2, 5, and 6.

The module case 100 may define the space in which the module 200 is stored. The module 200 may be separably coupled inside the module case 100. The module case 100 may be provided inside the housing 30 so as to be pulled outward from the housing 30. The module case 100 may have a size suitable for surrounding the exterior of the module 200, and may occupy a predetermined space inside the housing 30. The washstand cabinet 10 according to the present embodiment may include a plurality of module cases 100. The module cases 100 may divide the space inside the housing 30 so as to accommodate one or more modules therein.

The module case 100 according to one embodiment may include a front member (or front wall) 110 provided on the front surface of the washstand cabinet 10, a coupling portion (or coupling wall) 120 mating to at least one surface of the module 200 so as to be in contact with this surface of the module 200, and a drawer member (or sliders) 150 configured to guide a movement of the module case and to allow the user to pull the module case 100 outward from the housing 30 The front member 110 may define a portion of the external shape of the module case 100. Specifically, the front member 110 may define a portion of the external shape of the housing 30. The front member 110 according to one embodiment may be provided on the front surface of the washstand cabinet 10.

The coupling portion 120 may be coupled to the module 200, which is mounted inside the module case 100, so as to be in contact with the module 200. One surface of the coupling portion 120 may be the inner surface of the front member 110. The coupling portion 120 may have a shape corresponding to the external shape of the module 200 so that the module 200 may be received within the coupling portion 120. At least one surface of the coupling portion 120 may be exposed so as to be separably coupled to the module 200.

The coupling portion 120 according to one embodiment may include a front surface 122 located inside the front member 110, a rear surface 124 spaced apart from the front surface 122 so as to be parallel thereto, and a vertical side surface 126 interconnecting the front surface 122 and the rear surface 124. The coupling portion 120 according to the present embodiment may further include a bottom surface 128, which is provided under the front surface 122, the rear surface 124, and the side surface 126 so as to be orthogonal thereto. This configuration is given merely as an example, and some surfaces of the coupling portion 120, such as the side surface 126 may be omitted or one or more other surfaces may be added within the coupling portion 120.

One surface of the coupling portion 120 may include or may be coupled to the module recognition unit 420, which recognizes the type of module 20. For example, the module recognition unit 420 according to one embodiment may be a tactile switch 134 which may contact the module 200 to recognize the module type and may generate different signals to controller 400 depending on the type of the module 200. The module case 100 according to one embodiment may include a plurality of tactile switches 134, such as different tactile switches 134 located at different portions of the coupling portion 120. The module 200 may include a push device (or extension) 210, which contacts at least one of the tactile switches 134 provided on the module case 100. A different number of push devices 210 may be formed at different positions depending on the type of module 200. The signal input to the module case 100 may change depending on the number and positions of the tactile switches 134 that are pushed by each module 200.

Figure 5:
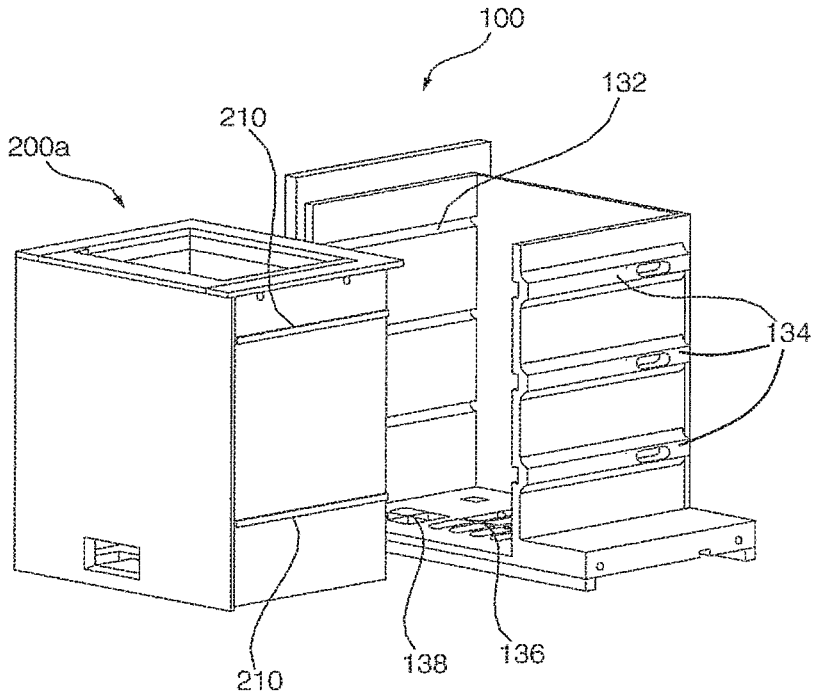
FIG. 5 shows views for explaining the coupling relationship of the module and the module case according to embodiments of the present disclosure.
Figure 5:
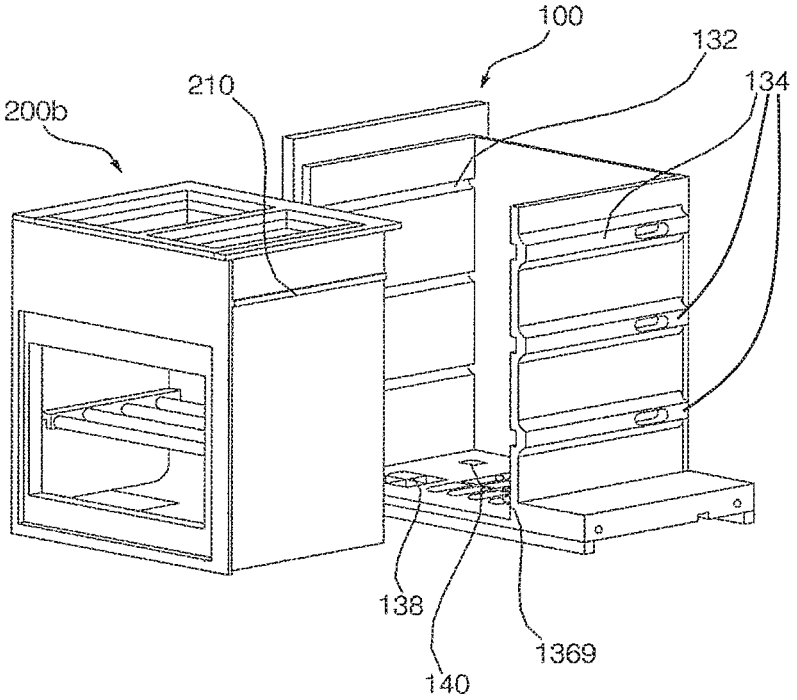

Referring to FIG. 5, the module case 100 according to one embodiment may include three tactile switches 134, which are provided in an upper portion, a middle portion and a lower portion of the rear surface 124. The specific module 200 illustrated in portion (a) of FIG. 5 is provided with two push devices 210, which are positioned to push the tactile switches 134 in the upper portion and the lower portion. Another module 200 illustrated in portion (b) of FIG. 5 includes one push device 210, which may be positioned so as to push the tactile switch 134 in the upper portion. The number and positions of push devices 210, which contact the tactile switches 134, may change depending on the type of each module 200. The controller 400 may recognize the type of a module 200 based on the signal input from the module case 100 identifying the number and positions of tactile switches 134 contacted by push devices 210 for that module 200.

Figure 6:
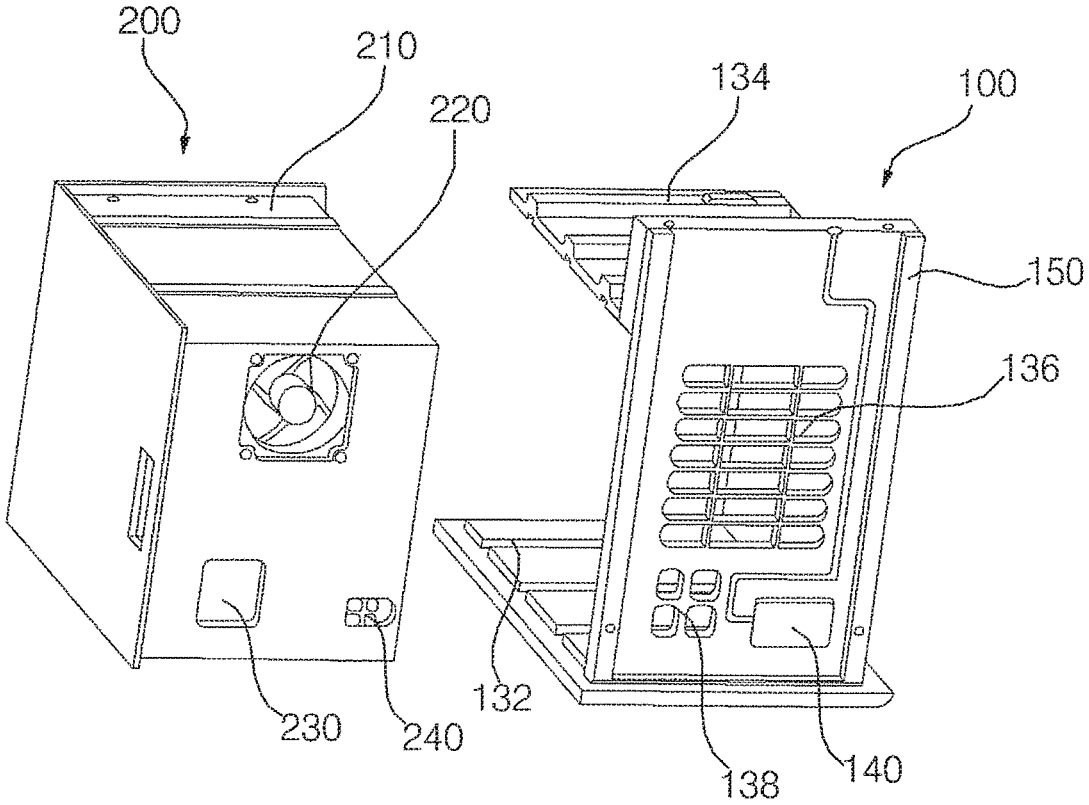
FIG. 6 is a view for explaining the module and the module case according to the embodiment of the present disclosure.

Referring to FIG. 6, the module case 100 may have a suction port 136 and a discharge port 138 for the movement of air to the inside and outside of the module 200. The suction port 136 and the discharge port 138 according to one embodiment may be formed in one surface of the coupling portion 120. The suction port 136 and the discharge port 138 according to one embodiment may be formed in the bottom surface of the coupling portion 120. Similarly, the module 200 may have a suction hole 220 and a discharge hole 230 for air movement at positions corresponding to the suction port 136 and the discharge port 138 of the module case 100. The module 200 may be equipped with a fan in the suction hole 220 or the discharge hole 230, as needed.

In the case where the air-conditioning module 300 (corresponding to module D) is provided under the modules A, B and C, as illustrated in FIG. 4(*c*), the air suctioned into the air-conditioning module D may move into the modules A, B and C, or the air inside the modules A, B and C may be discharged into the air-conditioning module D. Referring to FIG. 1, the air-conditioning module 300 may be provided in a lower region of the housing 30 and may have a discharge port through which air is discharged forward. The air-conditioning module 300 may move air internally in the housing 30 to the module 200, or may discharge air forward from the housing 30. In addition, in the washstand cabinet 10 having the modular structure illustrated in portion (a) of FIG. 4, the module may directly communicate with or contact the bottom surface of the housing 30 so that air may move between the inside of the module 200 and the outside of the washstand housing 10.

The module case 100 may be provided with the power supply unit (or power supply) 140, which supplies power to the module 200. The power supply unit 140 may be a circuit to regulate and supply power to drive a module 200, and the power supply unit may be provided on the portion of the module case 100 such that the power supply unit 140 is in contact with the module 200 in the state when the module 200 is mounted in the module case 100. The power supply unit 140 according to one embodiment may be provided on the bottom surface 128 of the module case 100. The module 200 may be provided with a module power unit 240, which is provided at a position corresponding to the power supply unit 140 so as to receive power from the power supply unit 140. Once the module 200 and the module case 100 have been coupled to each other, the module 200 may receive power from the power supply unit 140.

The coupling portion 120 may include the guide portion (ir guide extension) 132, which guides a movement of the module 200 so as to be mounted in the module case 100. The guide portion 132 may be formed on one surface of the coupling portion 120 that is coupled to the module 200 in a direction parallel to the direction in which the module 200 is inserted. Referring to FIG. 5, the guide portion 132 according to one embodiment may be provided on the front surface of the module case 100. The module 200 may have a guide roller (not illustrated) formed at a position corresponding to the guide portion 132.

The drawer member 150 may be used when pulling the module case 100 outward from the housing 30 or inserting the module case 100 into the housing 30. The drawer member 150 may cause the module case 100 to slide inside the housing 30 inwardly or outwardly relative to the housing 30. In one embodiment, the drawer member 150 may be provided on the bottom surface 128 of the module case 100.

The module case 100 may further have a hole or opening (not illustrated) connected to a flow path through which water is discharged. This hole serves to discharge water, for example, when a small dehydrator module 200*c* is mounted, as illustrated in portion (c) of FIG. 7. Water discharged from the small dehydrator module 200*c* may directed to a drain, which is connected to the washstand 20, to thereby be discharged outward from the washstand cabinet 10.

The module case 100 according to one embodiment may be pulled or otherwise moved outward from the housing 30 by a first method in which the module case 100 is substantially moved outward from the housing 30 using the drawer member 150 when pressure is applied to the front member 110. In addition, the module case 100 according to the present embodiment may be pulled outward from the housing 30 by a second method in which the user pulls the front member 110 so as to extract the module case 100. In the second method, the module case 100 according to one embodiment may include a handle by which the user opens or closes the module case 100.

In the washstand cabinet 10 according to one embodiment, the module recognition unit 420 and the power supply unit 140 may be provided inside the module case 100 in which the module 200 is mounted. The washstand cabinet 10 according to the present embodiment may omit the module case 100. When the module case 100 is not included in the housing 30, the washstand housing 30 according to the present embodiment may include the module recognition unit 420 and the power supply unit 140 inside the housing 30.

Figure 7:
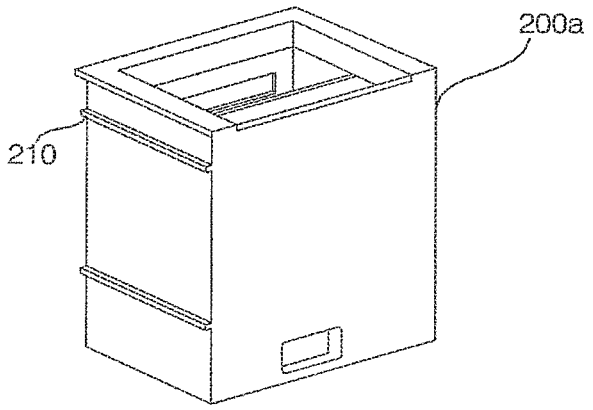
FIG. 7 are views illustrating a cosmetics refrigerator module, a sterilization dryer module, and a small dehydrator module according to embodiments of the present disclosure.
Figure 7:
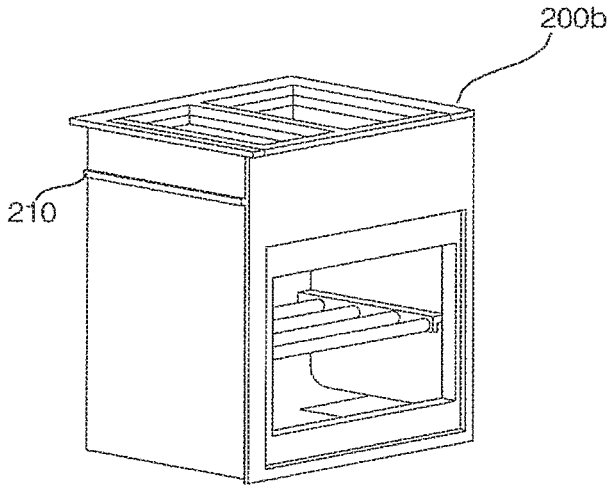
Figure 7:
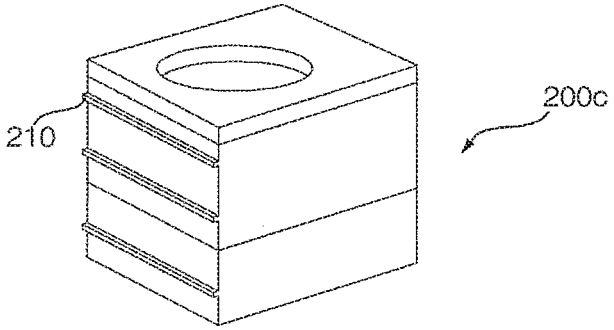

The module 200 mounted in the washstand cabinet 10 according to one embodiment may be an electric device that is electrically operated and is usable in a bathroom. Types of modules are depicted in FIG. 7 and include, for example, a cosmetics refrigerator module 200*a* of portion (a) if FIG. 7 that stores cosmetics at a low temperature. Another type of module 200 includes a sterilization dryer module 200*b* of portion (b) of FIG. 7, which sterilizes and dries bathroom articles such as, for example, toothbrushes and other tools. Still another type of module 200 may include a small dehydrator module 200*c* of portion (c) of FIG. 7. Other modules that may be used in a bathroom include, for example, a module that electrically charges and supports a device that suctions water remaining in a bathroom or a module that generates and stores sterilized water.

The shape and size of each module 200 may determined so that the module 200 may be stored in the module case 100. Thus, the user may select the module that the user wishes to use, and may mount the corresponding module in the module case 100 when in use. The module 200 may have a substantially rectangular outer shape. The module 200 is configured so as to be separably coupled to the module case 100.

When the module 200 is coupled to the module case 100, the module 200 may include the module power unit 240 to receive power from the power supply unit 140 of the module case 100. In addition, the module 200 may include the push device 210 when contacts one or more of the tactile switches 134 provided on the module case 100 when the module 200 is received within and coupled to the module case 100. As illustrated in portions (a)-(c) of FIG. 7, the number and positions of push devices 210 may be changed according to the type of each module.

The module power unit 240 and the push device 210 may be formed on the exterior of the module 200. When the module 200 is coupled to the module case 100, the power supply unit 140 of the module case 100 may electrically couple to (or dock with) the module power unit 240 of the module 200.

Figure 8:
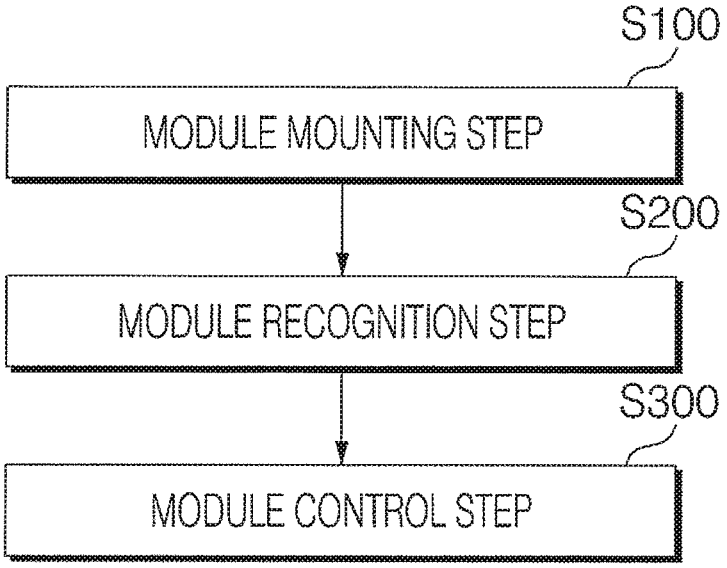
FIG. 8 is a flowchart illustrating a method of using the washstand cabinet according to the embodiment of the present disclosure.
Figure 9:
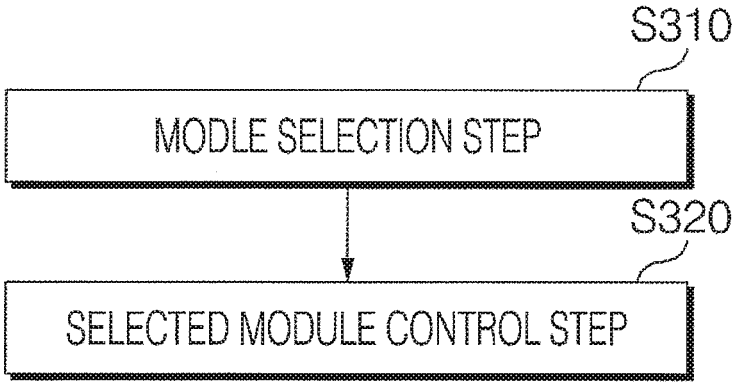
FIG. 9 is a flowchart concretely illustrating a module control step of FIG. 8.

FIG. 8 is a flowchart illustrating a method of using the washstand cabinet according to the embodiment of the present disclosure. FIG. 9 is a flowchart concretely illustrating a module control step of FIG. 8. Hereinafter, a method of mounting the module 200 in the washstand cabinet 100 and using the module 200 will be described with reference to FIGS. 8 and 9.

First, a step S100 of mounting the module in the washstand cabinet is performed. The module 200 may be mounted inside the housing 30, which is partitioned so as to accommodate at least one module 200 in the washstand cabinet 10. According to one embodiment, the module 200 may be mounted in the module case 100, which is provided inside the housing 30.

The module 200 may be mounted into the module case 100 via the guide portion 132 of the module case 100 when the module case 100 is pulled outward from the housing 30 using the drawer member 150. The module 200 mounted in the module case 100 may be provided inside the washstand cabinet 10 when the module case 100 is inserted into the housing 30 using the drawer member 150.

Thereafter, the controller 400 may perform a step S200 of recognizing the module. The controller 400 may perform the recognizing of the module 200 via the module recognition unit 420. The module case 100 according to one embodiment includes the tactile switches 134. The module 200 includes the push device 210, which contacts at least one of the tactile switches 134 depending on the type of the module 200. The positions and number of push devices 210 may be changed according to the type of module. Once the module 200 has been mounted in the module case 100, the tactile switches 134 provided on the module case 100 may transmit different signals depending on the number and positions of tactile switches 134 contacted by the to the controller 400. The controller 400 may recognize the module 200 by judging the signals transmitted from the tactile switches 134 of the module case 100.

Thereafter, the controller 400 performs a step 300 of controlling the recognized module 200. The controller 400 may perform control depending on the recognized module 200. Because the control may be changed depending on the type of module, the controller 200 may performs specific control suitable for the recognized module. For example, the controller may perform control related to dehydration when the module 200 is a small dehydrator module, and may perform control for sterilization when the module 200 is a sterilizer module for toothbrushes and/or other bathroom items.

The step S300 of controlling the recognized module may be performed such that any one of a plurality of modules provided in the washstand cabinet 10 is selected and the selected module is controlled. As illustrated in FIG. 9, control may be performed in such a manner that the user first selects one of a plurality of modules provided inside the washstand cabinet 10 (S310), after which the user controls the selected module (S320).

As is apparent from the above description, the present disclosure has the following effects. First, when an electric product is configured to have a modular structure so as to be provided in a washstand cabinet, efficient use of bathroom space may be secured. Second, because a module inside the washstand cabinet is replaceable, the module that the user requires may be selectively used, which ensures more effective use of bathroom space. Third, the washstand cabinet may function to recognize a module mounted therein and to perform control suitable for the recognized module.

Thus, one aspect of the present disclosure provides a space for disposing an electric product therein. It is another aspect of the present disclosure to provide a device, which recognizes and controls an electric product that a user wishes to use, in a washstand cabinet in which the electric product is provided. In accordance with the present disclosure, the above and other aspects may be accomplished by the provisioning of a washstand cabinet including a washstand having a water supply valve and a washing bowl in which water is accommodated, a housing provided under the washstand and defining a storage space therein, at least one module accommodated inside the housing, the module being electrically operated, and a controller configured to recognize the module and control the recognized module.

In accordance with another aspect of the present disclosure, a method of operating a washstand cabinet may include mounting a module inside the washstand cabinet, recognizing the mounted module, and controlling the recognized module.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washstand cabinet comprising:

a washstand having a water supply valve and a washing bowl in which water is accommodated;

a housing provided under the washstand and defining a storage space therein, the housing being configured to receive and accommodate an electronic device;

a case configured to device a space inside the housing into two or more spaces and to accommodate the electronic device therein; and a controller configured to recognize a type of the electronic device accommodated in the case and operate the recognized type of the electronic device;

wherein the case includes a surface having a plurality of guides that extend horizontally and are vertically separated, and a plurality of switches are provided on the plurality of guides;

wherein the electronic device includes at least one extension;

wherein the controller is further configured to recognize the type of the electronic device based on a quantity and position of switches of the plurality of switches in contact with the at least one extension of the electronic device when the electronic device is accommodated in the case, and wherein, when the electronic device is accommodated in the case, the at least one extension is received in at least one of the guides to contact at least one of the switches of the plurality of switches.

2. The washstand cabinet according to claim 1, wherein the at least one extension is a plurality of extensions which are provided in a different quantity and at one or more different positions depending on the type of the electronic device.

3. The washstand cabinet according to claim 1, further comprising a power supply configured to supply power to the electronic device.

4. The washstand cabinet according to claim 1, further comprising a user interface configured to receive an input to control the electronic device.

5. The washstand cabinet according to claim 1, wherein the case has a suction port and a discharge port for movement of air between an inside and an outside of the electronic device.

6. The washstand cabinet according to claim 1, wherein the case includes:

a front wall configured to form a portion of a front surface of the housing;

a coupling wall coupled to the electronic device; and a slider configured to open the electronic device case away from the housing.

7. The washstand cabinet according to claim 6, wherein the coupling wall includes:

a power supply configured to supply power to the electronic device.

8. The washstand cabinet according to claim 1, wherein the housing defines a space in which at least two electronic devices are accommodated in a front region thereof, and also defines a space in which a drain is provided in a rear region thereof.

9. The washstand cabinet according to claim 8, further comprising a dryer to discharge air to an outside of the housing and provided in the housing below the space where the two electronic devices are accommodated and the space in which the drain is provided.

10. A method of operating a washstand cabinet, the method comprising:

mounting an electrically-operated electronic device in a case provided inside the washstand cabinet, wherein the case includes a surface having a plurality of guides that extend horizontally and are vertically separated, and a plurality of switches are provided on the plurality of guides, wherein the electronic device includes at least one extension, and wherein, when the electronic device is accommodated in the case, the at least one extension of the electronic device is received in at least one of the guides to contact at least one of the switches of the plurality of switches;

recognizing a type of the electronic device mounted in the case based on a quantity and position of switches of the plurality of switches in contact with the at least one extension; and operating the electronic device based on the recognized type of the electronic device.

11. The method according to claim 10, wherein the washstand cabinet accommodates a plurality of electronic devices therein, and wherein operating the electronic device includes:

selecting one of the plurality of electronic devices; and operating the selected one of the plurality of electronic devices.

12. A washstand cabinet comprising:

a washstand having a water supply valve and a washing bowl in which water is accommodated;

a housing provided under the washstand and defining a storage space therein, the housing being configured to receive and accommodate an electronic device; and a case configured to divide a space inside the housing into two or more spaces and to accommodate the electronic device therein, the case including a surface having a plurality of guides that extend horizontally and are vertically separated, and a plurality of switches provided on the plurality of guides, wherein the electronic device includes a plurality of extensions, wherein, when the electronic device is accommodated in the case, the plurality of extensions of the electronic device are received in a respective one of the plurality of guides to contact one of the plurality of switches, and wherein the electronic device is configured such that a quantity of the plurality of extensions and an arrangement of the plurality of extensions vary according to a type of the electronic device.

13. The washstand cabinet according to claim 12, wherein the plurality of switches are each provided at different heights in the case.

* * * * *